US012779280B2

(12) United States Patent
Kim et al.

(10) Patent No.: US 12,779,280 B2
(45) Date of Patent: Nov. 3, 2026

(54) CHAIR-TYPE UPPER BODY EXERCISE DEVICE

(71) Applicant: Samsung Electronics Co., Ltd., Suwon-si (KR)

(72) Inventors: Donghyun Kim, Suwon-si (KR); Minhyung Lee, Suwon-si (KR); Junghoon Park, Suwon-si (KR); Seungyong Hyung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 173 days.

(21) Appl. No.: 18/799,305

(22) Filed: Aug. 9, 2024

(65) Prior Publication Data

US 2024/0399202 A1 Dec. 5, 2024

Related U.S. Application Data

(63) Continuation of application No. PCT/KR2023/001489, filed on Feb. 2, 2023.

(30) Foreign Application Priority Data

Feb. 24, 2022 (KR) ..... 10-2022-0024458

(51) Int. Cl.
*A63B 23/12* (2006.01)
*A47C 9/00* (2006.01)
(Continued)

(52) U.S. Cl.
CPC ..... *A63B 23/12* (2013.01); *A47C 9/002* (2013.01); *A63B 21/00* (2013.01);
(Continued)

(58) Field of Classification Search
CPC ..... A47C 9/002; A63B 21/00; A63B 21/0058; A63B 21/0442; A63B 21/0552;
(Continued)

(56) References Cited

U.S. PATENT DOCUMENTS 5,090,694 A * 2/1992 Pauls ..... A63B 21/015 482/904
5,234,394 A * 8/1993 Wilkinson ..... A63B 21/16 482/121
(Continued)

FOREIGN PATENT DOCUMENTS

CN 113171239 A 7/2021
CN 215136428 U 12/2021
(Continued)

OTHER PUBLICATIONS

International Search Report for PCT/KR2023/001489 mailed May 10, 2023, 4 pages.
(Continued)

*Primary Examiner* — Megan Anderson
(74) *Attorney, Agent, or Firm* — Nixon & Vanderhye P.C.

(57) ABSTRACT

A chair-type upper body exercise assistance device may include: a chair comprising a buttocks support part, a back support part, and a plurality of legs; a motor; a first string one end of which is connected to the motor and the other end of which is provided on the outside of the back support part; a second string; a first splitter which is arranged inside the back support part, is provided at a position spaced apart from the motor, and supports the first string; and a second splitter which is arranged inside the back support part, is provided at a position spaced apart from the motor, and supports the second string; a first elastic band connected to the first string; and a second elastic band connected to the second string.

15 Claims, 6 Drawing Sheets

(51) Int. Cl.

| | |
|---|---|
| ***A63B 21/00*** | (2006.01) |
| ***A63B 21/005*** | (2006.01) |
| ***A63B 21/04*** | (2006.01) |
| ***A63B 21/055*** | (2006.01) |
| ***A63B 21/16*** | (2006.01) |
| ***A63B 23/035*** | (2006.01) |

(52) U.S. Cl.
CPC ..... *A63B 21/0058* (2013.01); *A63B 21/0442* (2013.01); *A63B 21/0552* (2013.01); *A63B 21/151* (2013.01); *A63B 21/153* (2013.01); *A63B 21/1609* (2015.10); *A63B 21/4035* (2015.10); *A63B 23/03541* (2013.01)

(58) Field of Classification Search
CPC . A63B 21/151; A63B 21/153; A63B 21/1609; A63B 21/4035; A63B 23/03541; A63B 23/12
See application file for complete search history.

(56) References Cited

U.S. PATENT DOCUMENTS

| | | | | |
|---|---|---|---|---|
| 5,362,296 | A * | 11/1994 | Wang | A63B 23/12 482/121 |
| 7,806,812 | B2 * | 10/2010 | Humble | A63B 21/153 482/133 |
| 9,333,386 | B2 | 5/2016 | Alazet | |
| 10,888,485 | B2 * | 1/2021 | Fleming | A61H 1/0255 |
| 10,888,728 | B2 * | 1/2021 | Carriere | A63B 21/4005 |
| 11,612,781 | B1 * | 3/2023 | Eoff | A47C 1/022 482/130 |
| 12,564,752 | B2 * | 3/2026 | Kim | A63B 21/0058 |
| 2003/0032535 | A1 | 2/2003 | Wang | |

FOREIGN PATENT DOCUMENTS

| | | | |
|---|---|---|---|
| JP | H0722749 | B2 | 8/1995 |
| JP | 3896471 | B2 | 1/2007 |
| JP | 2008023273 | A | 2/2008 |
| JP | 2009502262 | A | 1/2009 |
| JP | 2009247451 | A | 10/2009 |
| KR | 200402221 | Y1 | 11/2005 |
| KR | 200403016 | Y1 | 12/2005 |
| KR | 20070017139 | A | 2/2007 |
| KR | 101232794 | B1 | 2/2013 |

OTHER PUBLICATIONS

Written Opinion of the ISA for PCT/KR2023/001489 mailed May 10, 2023, 3 pages.

* cited by examiner

CHAIR-TYPE UPPER BODY EXERCISE DEVICE

CROSS-REFERENCE TO RELATED APPLICATIONS

This application is a continuation application of International Application No. PCT/KR2023/001489 designating the United States, filed on Feb. 2, 2023, in the Korean Intellectual Property Receiving Office and claiming priority to Korean Patent Application No. 10-2022-0024458, filed on Feb. 24, 2022, in the Korean Intellectual Property Office, the disclosures of which are all hereby incorporated by reference herein in their entireties.

TECHNICAL FIELD

Various example embodiments relate to a chair-type upper body exercise device.

BACKGROUND ART

An exercise device refers to a device or an apparatus for helping a user exercise. In our rapidly aging society, a growing number of people experience inconvenience in exercising or have difficulty with exercising due to malfunctioning joints, and there is increasing interest in an exercise device. In addition, a demand for home fitness has been growing due to viruses that may be spread in spaces where all sorts of people are together.

The above description has been possessed or acquired by the inventor(s) in the course of conceiving the present disclosure and is not necessarily an art publicly known before the present application is filed.

SUMMARY

According to various example embodiments, a chair-type upper body exercise device may include a chair including a hip support portion configured to support a user's hips, a back support portion connected, directly or indirectly, to the hip support portion and configured to support a user's back, and a plurality of legs connected, directly or indirectly, to the hip support portion; a motor inside the back support portion; a first string, of which an end is connected, directly or indirectly, to the motor and the other end is outside the back support portion; a second string, of which an end is connected, directly or indirectly, to the motor at a position spaced apart from the first string and the other end is outside the back support portion; a first splitter inside the back support portion, at a position spaced apart from the motor, and configured to support the first string; a second splitter inside the back support portion, at a position spaced apart from the motor, and configured to support the second string; a first elastic band connected, directly or indirectly, to the first string; and a second elastic band connected, directly or indirectly, to the second string.

In various example embodiments, wherein at least one of the motor and the first and second strings is/are configured so that a degree of the first string twined with the second string may be adjusted based on the driving of the motor.

In various example embodiments, the back support portion may include a front frame including a front frame body facing the user's back, a first string hole formed through the front frame body and accommodating the first string, and a second string hole formed through the front frame body and accommodating the second string; and a rear frame connected, directly or indirectly, to the front frame.

In various example embodiments, a distance between the first elastic band and the first string hole and a distance between the second elastic band and the second string hole may be adjusted at the same time based on the driving of the motor.

In various example embodiments, the motor may include a motor body fixed to the back support portion and configured to generate power and a motor head rotatably connected, directly or indirectly, to the motor body and configured to support the first string and the second string.

In various example embodiments, at least one string of the first string and the second string may be connected, directly or indirectly, to the motor head at a position spaced apart from a rotation axis of the motor head.

In various example embodiments, when the motor head may rotate in a first direction, the first string may be further twined with the second string, and the first elastic band and the second elastic band may get respectively close to the first string hole and the second string hole, and, when the motor head rotates in a second direction that is opposite to the first direction, the first string may be untwined from the second string, and the first elastic band and the second elastic band may get respectively away from the first string hole and the second string hole.

In various example embodiments, the front frame may further include a plurality of front frame ribs protruding from the front frame body toward the rear frame.

In various example embodiments, the back support portion may further include a guide protruding from any one frame of the front frame and the rear frame and configured to guide the first string.

In various example embodiments, the guide may include a first opening that opens toward the first splitter and a second opening that opens toward the first string hole, in which a central portion of the guide may have an upwardly convex shape.

In various example embodiments, the chair-type upper body exercise device may further include a pipe in the back support portion, in which an upper portion of the pipe is positioned between the first splitter and the first string hole.

In various example embodiments, the back support portion may be in a direction crossing a longitudinal direction of the pipe, may include a more rigid material than the front frame, and may further include a plate surrounding the first string hole and the second string hole.

In various example embodiments, the motor may be closer to the hip support portion than the first splitter and the second splitter.

In various example embodiments, the first splitter may include a splitter base; a pair of blocks each fixed to the splitter base and accommodating a first string; a slider positioned between the pair of blocks, slidable relative to the pair of blocks, and accommodating the first string; and a load cell positioned in the splitter base and configured to support the slider.

In various example embodiments, the chair-type upper body exercise device may further include a first handle connected, directly or indirectly, to the first elastic band and a second handle connected, directly or indirectly, to the second elastic band.

In various example embodiments, the chair-type upper body exercise device may further include at least one control button positioned in the chair and configured to control an operation of the motor.

DETAILED DESCRIPTION

Figure 1:
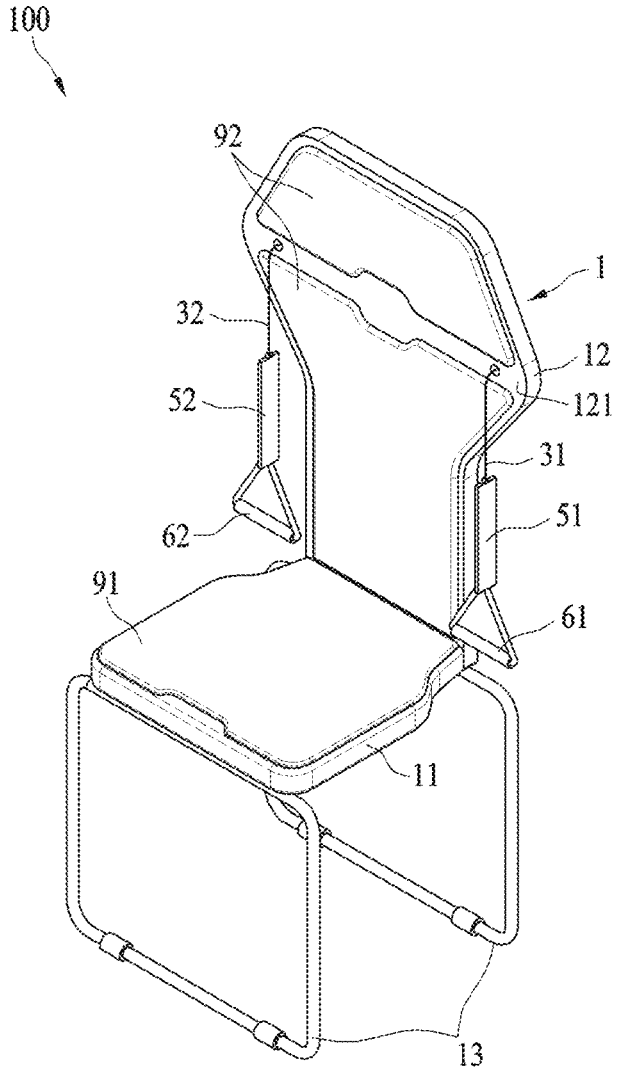
FIG. 1 is a perspective view of a chair-type upper body exercise device according to an example embodiment.

The following detailed structural or functional description is provided as an example only and various alterations and modifications may be made to embodiments. Accordingly, the example embodiments are not construed as limited to the disclosure and should be understood to include all changes, equivalents, and replacements within the idea and the technical scope of the disclosure.

Terms, such as first, second, and the like, may be used herein to describe various components. Each of these terminologies is not used to define an essence, order or sequence of a corresponding component but used merely to distinguish the corresponding component from other component(s). For example, a "first" component may be referred to as a "second" component, and similarly, the "second" component may be referred to as the "first" component.

It should be noted that if it is described that one component is "connected", "coupled", or "joined" to another component, at least a third component(s) may be "connected", "coupled", and "joined" between the first and second components, although the first component may be directly connected, coupled, or joined to the second component. Thus, "connected" for example covers both direct and indirect connections.

The singular forms "a", "an", and "the" are intended to include the plural forms as well, unless the context clearly indicates otherwise. It will be further understood that the terms "comprises/comprising" and/or "includes/including" when used herein, specify the presence of stated features, integers, steps, operations, elements, and/or components, but do not preclude the presence or addition of one or more other features, integers, steps, operations, elements, components and/or populations thereof.

The same name may be used to describe an element included in the example embodiments described above and an element having a common function. Unless otherwise mentioned, the descriptions of the example embodiments may be applicable to the following example embodiments, and thus duplicated descriptions will be omitted for conciseness.

Unless otherwise defined, all terms, including technical and scientific terms, used herein have the same meaning as commonly understood by one of ordinary skill in the art to which this disclosure pertains. Terms, such as those defined in commonly used dictionaries, are to be interpreted as having a meaning that is consistent with their meaning in the context of the relevant art and are not to be interpreted in an idealized or overly formal sense unless expressly so defined herein.

Hereinafter, embodiments will be described in detail with reference to the accompanying drawings. When describing the embodiments with reference to the accompanying drawings, like reference numerals refer to like elements and a repeated description related thereto will be omitted.

Figure 2:
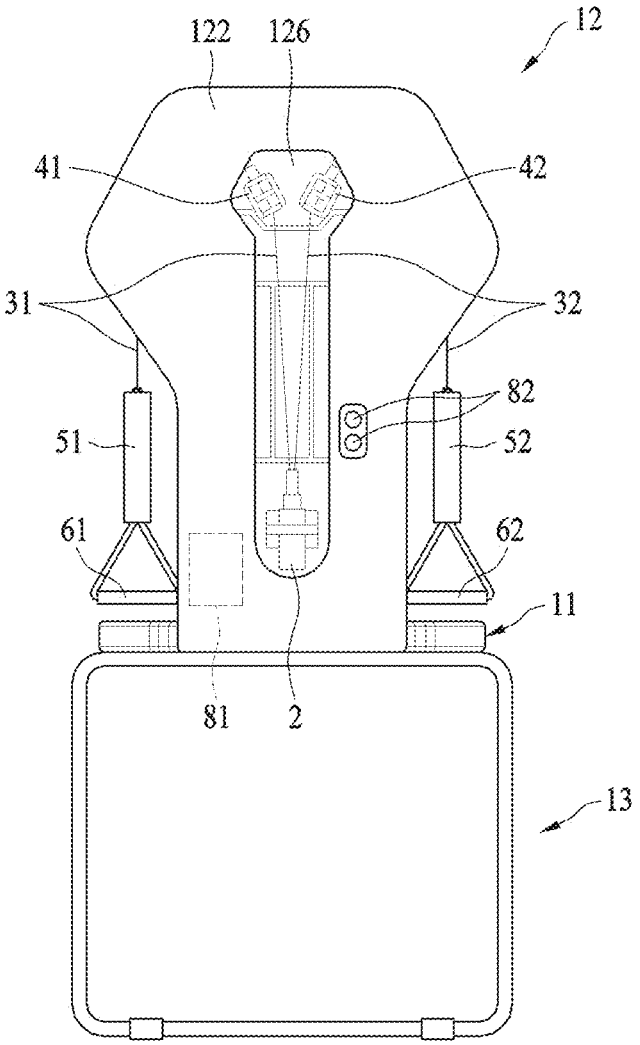
FIG. 2 is a rear view of the chair-type upper body exercise device according to an example embodiment.
Figure 3:
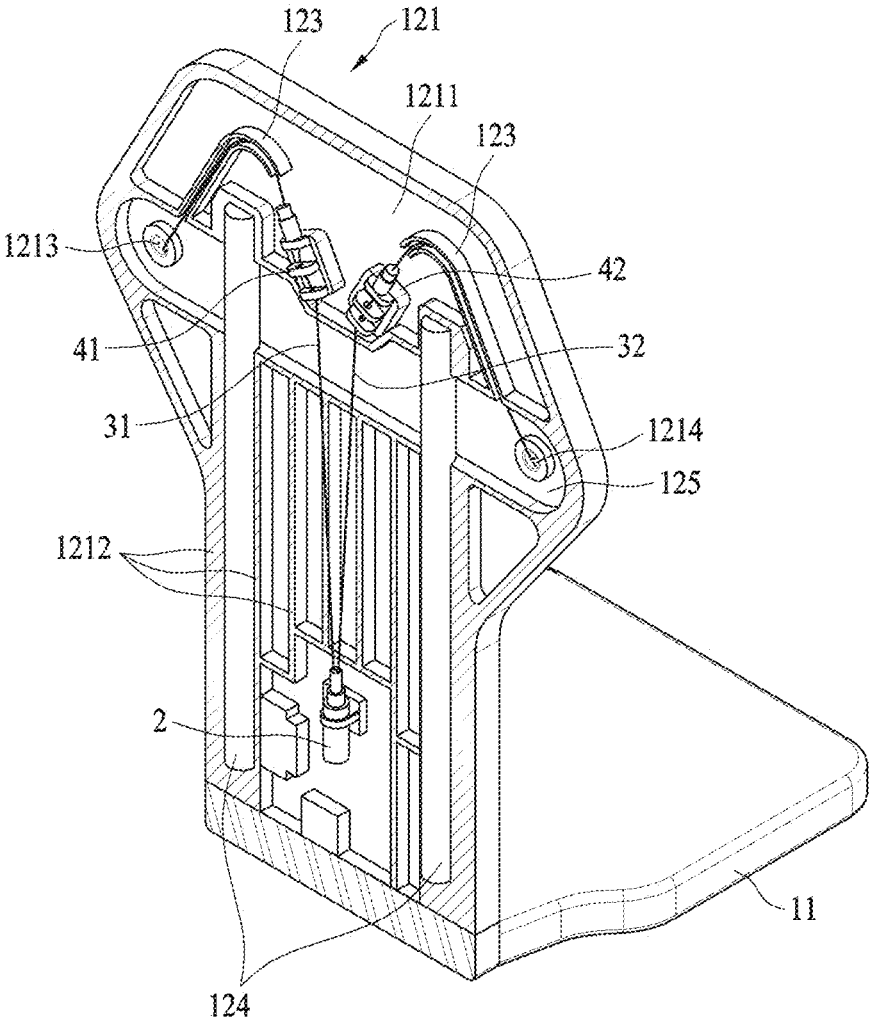
FIG. 3 is a perspective view schematically illustrating the internal structure of the chair-type upper body exercise device according to an example embodiment.

FIG. 1 is a perspective view of a chair-type upper body exercise device according to an embodiment, FIG. 2 is a rear view of the chair-type upper body exercise device according to an embodiment, and FIG. 3 is a perspective view schematically illustrating the internal structure of the chair-type upper body exercise device according to an embodiment.

Referring to FIGS. 1 to 3, a chair-type upper body exercise device 100 (hereinafter referred to as an exercise device), according to an embodiment, may support a user. The exercise device 100 may support the user's hips and back. The user may perform various exercises while sitting on the exercise device 100.

The exercise device 100 may have a chair shape. The exercise device 100 may be used as a general chair. The user may perform a desired exercise by selectively gripping elastic bands 51 and 52 and/or handles 61 and 62 only when the user desires to do an exercise.

The user may perform various exercises by using the exercise device 100. For example, the user may perform at least one of an arm exercise, a shoulder exercise, and a chest exercise by using the exercise device 100.

The exercise device 100 may include a chair 1, a motor 2, a pair of strings 31 and 32, a pair of splitters 41 and 42, a pair of elastic bands 51 and 52, a pair of handles 61 and 62, a controller 81 comprising processing circuitry, a control button 82, a hip cushion 91, and a back cushion 92.

The chair 1 may support the user. The chair 1 may include a hip support portion 11 configured to support the user's hips, a back support portion 12 configured to support the user's back, and a plurality of legs 13 connected, directly or indirectly, to the hip support portion. The hip support portion 11 may be connected, directly or indirectly, to the back support portion 12. For example, the hip support portion 11 may be integrally formed with the back support portion 12. For example, the hip support portion may be connected, directly or indirectly, to the back support portion 12 through separate connecting members.

The back support portion 12 may have a hollow inside. Various components for generating load for exercise may be provided inside the back support portion 12. For example, a motor 2, at least a portion of the pair of strings 31 and 32, and the pair of splitters 41 and 42 may be inside the back support portion 12. At least a portion of each of the pair of strings 31 and 32 may be inside the back support portion 12, and the remaining portion thereof may be outside the back support portion 12. The back support portion 12 may include a front frame 121 facing the user's back, a rear frame 122 connected, directly or indirectly, to the front frame 121, and glass 126 on the rear frame 122.

The glass 126 may be, for example, in a central portion of the rear frame 122. The glass 126 may include a transparent material. The user may see components inside the back support portion 12 through the glass 126.

The hip support portion 11 may have a hollow inside. For example, the hip support portion 11 may receive at least a portion of a pipe to increase the rigidity of the chair.

The plurality of legs 13 may separate the hip support portion 11 from the ground. It should be noted that the number of legs 13 is sufficient only when they stably support the hip support portion 11, and the number is not limited to the number illustrated in the drawings.

The motor 2 may generate load for exercise. The motor 2 may be inside the back support portion 12. The motor 2 may twine or untwine the pair of strings 31 and 32. For example, the motor 2 may operate in a first direction to twine the pair of strings 31 and 32. When the degree of twining of the pair of strings 31 and 32 increases, the length of the pair of strings 31 and 32 exposed to the outside of the back support portion 12 may decrease. For example, the motor 2 may operate in a second direction to untwine the pair of strings 31 and 32. When the degree of twining of the pair of strings 31 and 32 decreases, the length of the pair of strings 31 and 32 exposed to the outside of the back support portion 12 may increase.

One end of the pair of strings 31 and 32 may be connected, directly or indirectly, to the motor 2, and the other end thereof may be outside the back support portion 12. The pair of strings 31 and 32 may include a first string 31 and a second string 32. Each of the first string 31 and the second string 32 may be connected, directly or indirectly, to the motor 2 in different positions. For example, based on a portion connected, directly or indirectly, to the motor 2, the first string 31 may be spaced apart from the second string 32. At least one string of the first string 31 and the second string 32 may be connected, directly or indirectly, to the motor 2 at a position spaced apart from a rotation axis of the motor 2.

The pair of strings 31 and 32 may have a material that is not elastically transformable. For example, the pair of strings 31 and 32 may have a relatively less elastic material compared to the pair of elastic bands 51 and 52.

The pair of splitters 41 and 42 may be inside the back support portion 12 and at a position spaced apart from the motor 2. The pair of splitters 41 and 42 may include a first splitter 41 supporting the first string 31 and a second splitter 42 supporting the second string 32. The pair of splitters 41 and 42 may be at a position spaced apart from the motor 2. For example, the pair of splitters 41 and 42 may be at a position upwardly spaced apart from the motor 2. Structural stability may be enhanced by positioning the motor 2 that is relatively heavy close to the hip support portion 11. The pair of splitters 41 and 42 may support the pair of strings 31 and 32 while being spaced apart from the motor 2. A portion of the pair of strings 31 and 32 on the side toward the motor 2 based on the pair of splitters 41 and 42 may be twined by an operation of the motor 2. Since being spaced apart from each other in a portion on the side opposite to the motor 2 based on the pair of splitters 41 and 42, the pair of strings 31 and 32 may not be twined even when the motor 2 operates. The pair of splitters 41 and 42 may set a maximum or high range in which the first string 31 may be twined with the second string 32.

The pair of elastic bands 51 and 52 may include a first elastic band 51 connected to the first string 31 and a second elastic band 52 connected to the second string 42. The pair of elastic bands 51 and 52 may have an elastically transformable material. For example, the pair of strings 31 and 32 may have a relatively more elastic material compared to the pair of elastic bands 51 and 52.

The pair of handles 61 and 62 may include a first handle 61 connected to the first elastic band 51 and a second handle 62 connected to the second elastic band 52. For example, each of the pair of handles 61 and 62 may include an accommodating portion for accommodating the user's hand and a rod portion that may be gripped by the user. For example, each of the pair of handles 61 and 62 may have a triangular shape. It should be noted that the shape of the handle is not limited to the foregoing example.

The controller 81, comprising processing circuitry, may control the driving of the motor 2. The controller 81 may control an operating direction of the motor 2 or may control a rotational strength of the motor 2. The controller 81 may be electrically connected to the motor 2. Based on the driving of the motor 2, the degree of the first string 31 twined with the second string 32 may be adjusted. "Based on" as used herein covers based at least on.

The control button 82 may be on the chair 1 and may control an operation of the motor 2. For example, the control button 82 may be electrically connected to the controller 81. The control button 82 may transmit an input signal to the controller 81. For example, the control button 82 may include a power on/off button and/or a load adjustment button.

The hip cushion 91 may be on the hip support portion 11 and may include a softer material than the hip support portion 11. The hip cushion 91 may absorb some of the impact applied to the user's hips when the user sits on the chair 1.

The back cushion 92 may be on the back support portion 12 and may include a softer material than the back support portion 12. The back cushion 92 may absorb some of the impact applied to the user's back when the user sits on the chair 1.

The back support portion 12 may include the front frame 121, the rear frame 122, a pair of guides 123, a pair of pipes 124, a plate 125, and the glass 126.

The front frame 121 may include a front frame body 1211 facing the user's back, at least one front frame rib 1212 protruding from the front frame body 1211, a first string hole 1213 formed through the front frame body 1211 and accommodating the first string 31, and a second string hole 1214 formed through the front frame body 1211 and accommodating the second string 32.

The front frame rib 1212 may protrude from the front frame body 1211 toward the rear frame 122. The front frame rib 1212 may increase the rigidity of the front frame body 1211.

The first string hole 1213 may be symmetrically opposite to the second string hole 1214 based on the center of the front frame body 1211.

The rear frame 122 may be connected to the front frame 121. The rear frame 122 may be detachably connected to the front frame 121. When the rear frame 122 is separated from the front frame 121, the hollow of the back support portion 12 may be open to the outside.

The pair of guides 123 may protrude from any one frame of the front frame 121 and the rear frame 122 and may guide the pair of strings 31 and 32. Although illustrated as being formed on the front frame 121 in the drawings, the pair of guides 123 may also be formed on the rear frame 122. Any one of the pair of guides 123 may support the first string 31, and the other guide may support the second string 32. The pair of guides 123 may be symmetrical to each other. Hereinafter, the guide supporting the first string 31 is mainly described of the pair of guides 123. It should be noted that the description of the guide supporting the first string 31 also applies to the other guide supporting the second string 32.

A guide 123 may have a first opening that opens toward the first splitter 41 and a second opening that opens toward the first string hole 1213. The first string 31 that has passed the first splitter 41 may enter the guide 123, and the first string 31 that has passed the guide 123 may enter the first string hole 1213.

The guide 123 may have a central portion that is upwardly convex. The guide 123 may not be in a space between the first splitter 41 and the first string hole 1213. In this structure, a component to increase the rigidity of the back support portion 12 may be arranged in a wider area.

The pair of pipes 124 may be on the back support portion 12. The pair of pipes 124 may be approximately parallel to the height direction of the back support portion 12. The pair of pipes 124 may include a first pipe, the upper portion of which is between the first splitter 41 and the first string hole 1213, and a second pipe, the upper portion of which is between the second splitter 42 and the second string hole 1214.

The plate 125 may be in a direction crossing the longitudinal direction of the pipe 124, may include a more rigid material than the front frame 121, and may surround the first string hole 1213 and the second string hole 1214. A relatively heavy load may be applied to the first string hole 1213 and the second string hole 1214 due to the direct contact with the first string 31 and the second string 32. The plate 125 may increase the rigidity of the front frame 121 near the first string hole 1213 and the second string hole 1214.

A distance between the first elastic band 51 and the first string hole 1213 and a distance between the second elastic band 52 and the second string hole 1214 may be adjusted at the same time based on the driving of the motor 2. The motor 2 may include a motor body 21 fixed to the back support portion 12 and configured to generate power and a motor head 22 rotatably connected to the motor body 21. The motor head 22 may support the first string 31 and the second string 32.

When the motor head 22 rotates in a first direction (e.g., a clockwise direction), the first string 31 may be further twined with the second string 32, and the first elastic band 51 and the second elastic band 52 may get respectively close to the first string hole 1213 and the second string hole 1214. With the first elastic band 51 and the second elastic band 52 being respectively close to the first string hole 1213 and the second string hole 1214, the user may apply relatively great power by using both hands to move the pair of handles 61 and 62 to a set position. In this case, the intensity of exercise performed by the user may increase.

When the motor head 22 rotates in a second direction (e.g., a counterclockwise direction), the first string 31 may be untwined from the second string 32, and the first elastic band 51 and the second elastic band 52 may get respectively away from the first string hole 1213 and the second string hole 1214. With the first elastic band 51 and the second elastic band 52 being respectively away from the first string hole 1213 and the second string hole 1214, the user may apply relatively small power by using both hands to move the pair of handles 61 and 62 to the set position. In this case, the intensity of exercise performed by the user may decrease.

The user may appropriately set the degree of the first string 31 twined with the second string 32 through the controller 81, the control button 82, and the motor 2, and may perform an exercise with a desired intensity. After completing the intensity setting, the user may perform various exercises by moving the pair of handles 61 and 62 to various paths.

Figure 4:
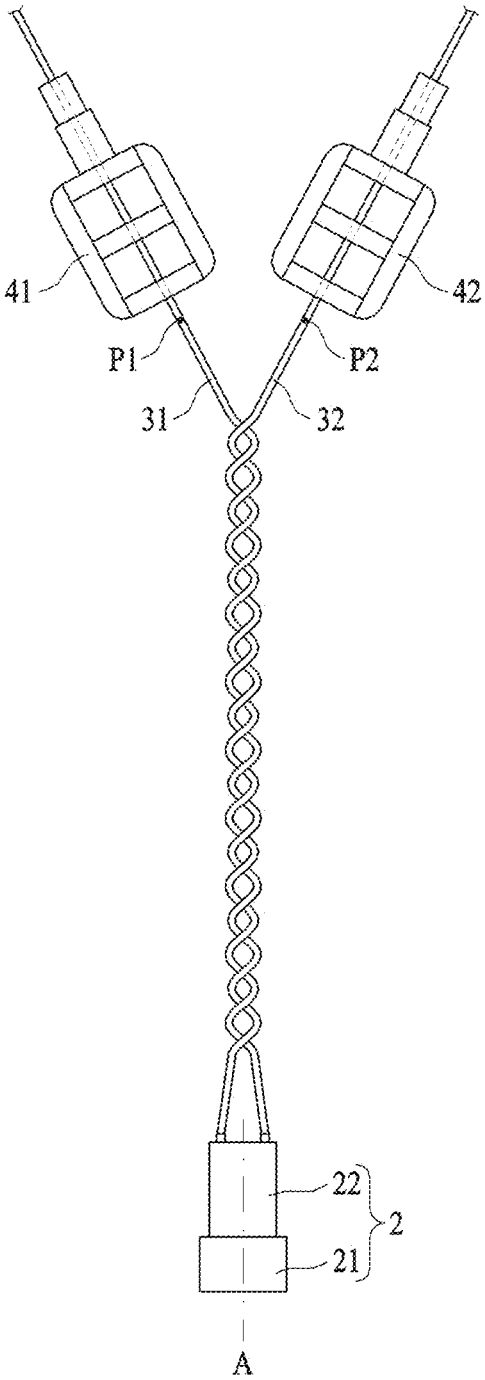
FIG. 4 is a front view schematically illustrating a state where a first string is relatively less twined with a second string, according to an example embodiment.
Figure 5:
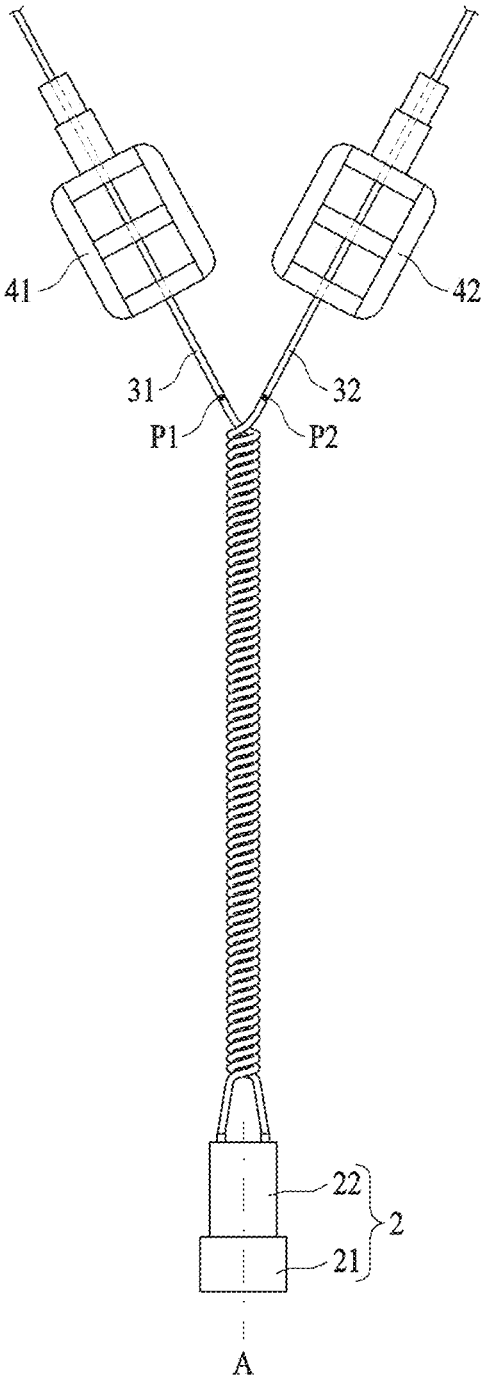
FIG. 5 is a front view schematically illustrating a state where a first string is relatively more twined with a second string, according to an example embodiment.

FIG. 4 is a front view schematically illustrating a state where a first string is relatively less twined with a second string, according to an embodiment, and FIG. 5 is a front view schematically illustrating a state where a first string is relatively more twined with a second string, according to an embodiment.

Referring to FIGS. 4 and 5, the motor 2 may include the motor body 21 and the motor head 22. The pair of splitters 41 and 42 may be at a position spaced apart from the motor 2. In an area between the motor 2 and the pair of splitters 41 and 42, the degree of twining of the pair of strings 31 and 32 may be adjusted.

For example, a first point P1, which is a random point of the first string 31, and a second point P2, which is a random point of the second string 32, may be respectively away from the first splitter 41 and the second splitter 42 as the first string 31 is relatively more twined with the second string 32.

At least one string of the first string 31 and the second string 32 may be connected to the motor head 22 at a position spaced apart from a rotation axis A of the motor head 22.

Figure 6:
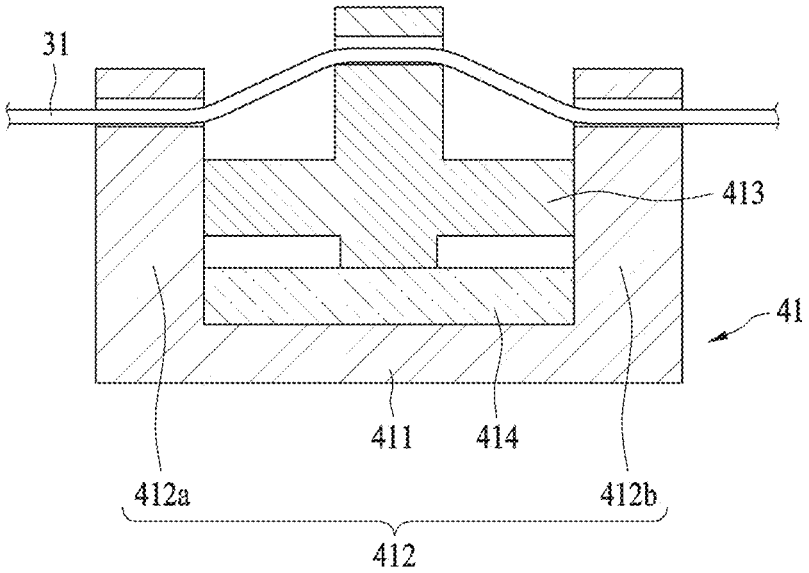
FIG. 6 is a cross-sectional view of a first splitter according to an example embodiment.

FIG. 6 is a cross-sectional view of a first splitter according to an embodiment.

Referring to FIG. 6, the first splitter 41 may include a splitter base 411 in the back support portion 12, a pair of blocks 412 each fixed to the splitter base 411, a slider 413 positioned between the pair of blocks 412 and slidable relative to the pair of blocks 412, and a load cell 414 positioned in the splitter base 411 and configured to support the slider 413.

The pair of blocks 412 and the slider 413 may accommodate the first string 31. For example, the pair of blocks 412 and the slider 413 may have a hole or a groove to accommodate the first string 31. The pair of blocks 412 may include a first block 412*a* and a second block 412*b* that are opposite to each other based on the slider 413.

Tension applied to the first string 31 may act to move the slider 413 downward. When the tension applied to the first string 31 increases, the force that moves the slider 413 downward may also increase. The load cell 414 may measure a pressure applied from the slider 413. Data measured by the load cell 414 may be transmitted to the controller 81. For example, the controller 81 may control the motor 2, based on the pressure information measured by the load cell 414.

It should be noted that the description of the first splitter 41 also applies to the description of the second splitter 42 (referring to FIG. 2).

As described above, although the examples have been described with reference to the limited drawings, a person skilled in the art may apply various technical modifications and variations based thereon. For example, suitable results may be achieved if the described techniques are performed in a different order, and/or if components in a described system, architecture, device, or circuit are combined in a different manner, or replaced or supplemented by other components or their equivalents. While the disclosure has been illustrated and described with reference to various embodiments, it will be understood that the various embodiments are intended to be illustrative, not limiting. It will further be understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

Therefore, other implementations, other example embodiments, and/or equivalents of the claims are within the scope of the following claims.

The invention claimed is:

1. A chair-type upper body exercise device comprising:

a chair comprising a hip support portion configured to support hips of a user, a back support portion connected to the hip support portion and configured to support a back of the user, and a plurality of legs connected to the hip support portion;

a motor at least partially inside the back support portion;

a first string, of which an end is connected to the motor and the other end is outside the back support portion;

a second string, of which an end is connected to the motor at a position spaced apart from the first string and the other end is outside the back support portion;

a first splitter inside the back support portion, at a position spaced apart from the motor, and configured to support the first string;

a second splitter at least partially inside the back support portion, at a position spaced apart from the motor, and configured to support the second string;

a first elastic band connected to the first string; and a second elastic band connected to the second string, wherein at least the motor and the first and second strings are configured so that a degree of the first string twined with the second string is to be adjusted based on driving of the motor.

2. The chair-type upper body exercise device of claim 1, wherein the back support portion comprises:

a front frame comprising a front frame body configured to face the back of the user, a first string hole formed through the front frame body and accommodating the first string, and a second string hole formed through the front frame body and accommodating the second string; and a rear frame connected to the front frame.

3. The chair-type upper body exercise device of claim 2, wherein the back support portion further comprises:

a guide protruding from any one frame of the front frame and the rear frame and configured to guide the first string.

4. The chair-type upper body exercise device of claim 3, wherein the guide comprises a first opening that opens toward the first splitter and a second opening that opens toward the first string hole, wherein a central portion of the guide has an upwardly convex shape.

5. The chair-type upper body exercise device of claim 4, further comprising:

a pipe in the back support portion, wherein an upper portion of the pipe is positioned between the first splitter and the first string hole.

6. The chair-type upper body exercise device of claim 5, wherein the back support portion is in a direction crossing a longitudinal direction of the pipe, comprises a more rigid material than the front frame, and further comprises a plate surrounding the first string hole and the second string hole.

7. The chair-type upper body exercise device of claim 2, wherein the motor comprises:

a motor body fixed to the back support portion and configured to generate power; and a motor head rotatably connected to the motor body and configured to support the first string and the second string.

8. The chair-type upper body exercise device of claim 7, wherein at least one string of the first string and the second string is connected to the motor head at a position spaced apart from a rotation axis of the motor head.

9. The chair-type upper body exercise device of claim 7, wherein, the motor head is configured so that:

when the motor head rotates in a first direction, the first string is further twined with the second string, and the first elastic band and the second elastic band get respectively close to the first string hole and the second string hole, and, when the motor head rotates in a second direction that is opposite to the first direction, the first string is untwined from the second string, and the first elastic band and the second elastic band get respectively away from the first string hole and the second string hole.

10. The chair-type upper body exercise device of claim 2, wherein the chair-type upper body exercise device is configured so that a distance between the first elastic band and the first string hole and a distance between the second elastic band and the second string hole are capable of being adjusted at the same time based on the driving of the motor.

11. The chair-type upper body exercise device of claim 2, wherein the front frame further comprises a plurality of front frame ribs protruding from the front frame body toward the rear frame.

12. The chair-type upper body exercise device of claim 1, wherein the motor is closer to the hip support portion than the first splitter and the second splitter.

13. The chair-type upper body exercise device of claim 1, wherein the first splitter comprises:

a splitter base;

a pair of blocks each fixed to the splitter base and accommodating a first string;

a slider positioned between at least the pair of blocks, slidable relative to the pair of blocks, and accommodating the first string; and a load cell positioned in the splitter base and configured to support the slider.

14. The chair-type upper body exercise device of claim 1, wherein a first handle is connected to the first elastic band; and a second handle is connected to the second elastic band.

15. The chair-type upper body exercise device of claim 1, wherein at least one control button is configured to control an operation of the motor.

* * * * *